US006148829A

United States Patent [19]

De Benedictis

[11] Patent Number: 6,148,829

[45] Date of Patent: Nov. 21, 2000

[54] HAIR TREATMENT DEVICE AND METHOD

[76] Inventor: Alfredo De Benedictis, 30 Falcon Avenue, Springfield Milton Keynes, Buckinghamshire MK6 3HJ, United Kingdom

[21] Appl. No.: 09/194,814

[22] PCT Filed: Jun. 6, 1997

[86] PCT No.: PCT/GB97/01540

§ 371 Date: Dec. 2, 1998

§ 102(e) Date: Dec. 2, 1998

[87] PCT Pub. No.: WO97/46132

PCT Pub. Date: Dec. 11, 1997

[30] Foreign Application Priority Data

Jun. 6, 1996 [GB] United Kingdom ..... 9611816

[51] Int. Cl.[7] ..... A45D 7/04; A45D 2/00; A45D 19/18

[52] U.S. Cl. ..... 132/207; 132/222; 132/270

[58] Field of Search ..... 132/206, 207, 132/222, 270, 210, 275, 277

[56] References Cited

U.S. PATENT DOCUMENTS

| | | | |
|---|---|---|---|
| 2,811,159 | 10/1957 | Stanton | 132/222 |
| 3,452,759 | 7/1969 | Sarinelli | 132/270 |
| 3,543,771 | 12/1970 | Altman | 132/222 |
| 3,610,257 | 10/1971 | Hall | 132/270 |
| 3,692,032 | 9/1972 | Regas | 132/212 |
| 3,805,810 | 4/1974 | Savala | 132/200 |
| 4,372,329 | 2/1983 | Brown | 132/40 |
| 5,056,538 | 10/1991 | Matual | 132/208 |
| 5,076,299 | 12/1991 | Wistrand et al. | 132/253 |
| 5,411,040 | 5/1995 | Forrest | 132/211 |
| 5,584,309 | 12/1996 | Benedictis | 132/308 |
| 5,771,906 | 6/1998 | Benedictis | 132/207 |

FOREIGN PATENT DOCUMENTS

| | | | |
|---|---|---|---|
| WO9522920 | 8/1995 | WIPO | 132/222 |

*Primary Examiner*—John J. Wilson
*Assistant Examiner*—Robyn Kieu Doan
*Attorney, Agent, or Firm*—Lee, Mann, Smith, McWilliams, Sweeney & Ohlson

[57] ABSTRACT

A method of treating a tress of hair including waving of the tress of hair includes the steps of inserting the tress of hair with a required formation into a hollow device and then while retained in hollow device the tress of hair is treated with a chemical substance. Preferably for convenience of use the hollow device comprises an extendible tube (12, 60). One end of the tube is secured to the root end of a tress of hair and the tube is extended lengthwise. The tube is then returned to its unextended state while ensuring that the tress of hair is retained within the tube. Preferably the device comprises a base element (10, 50) secured to one end of the tube, an upper element (11, 51) secured to a second end of the tube and a body member (13, 52) located intermediate the upper element and the base element to locate the upper element relative to the base element and to provide a housing for the extendible tube (12, 60). The base element is provided with means (18, 65) to secure the base element to a root end of a tress of hair and the upper element is formed to prevent egress of the tress of hair and to provide a funnel for application of treatment substance to the tress of hair.

19 Claims, 3 Drawing Sheets

HAIR TREATMENT DEVICE AND METHOD

Figure 1:
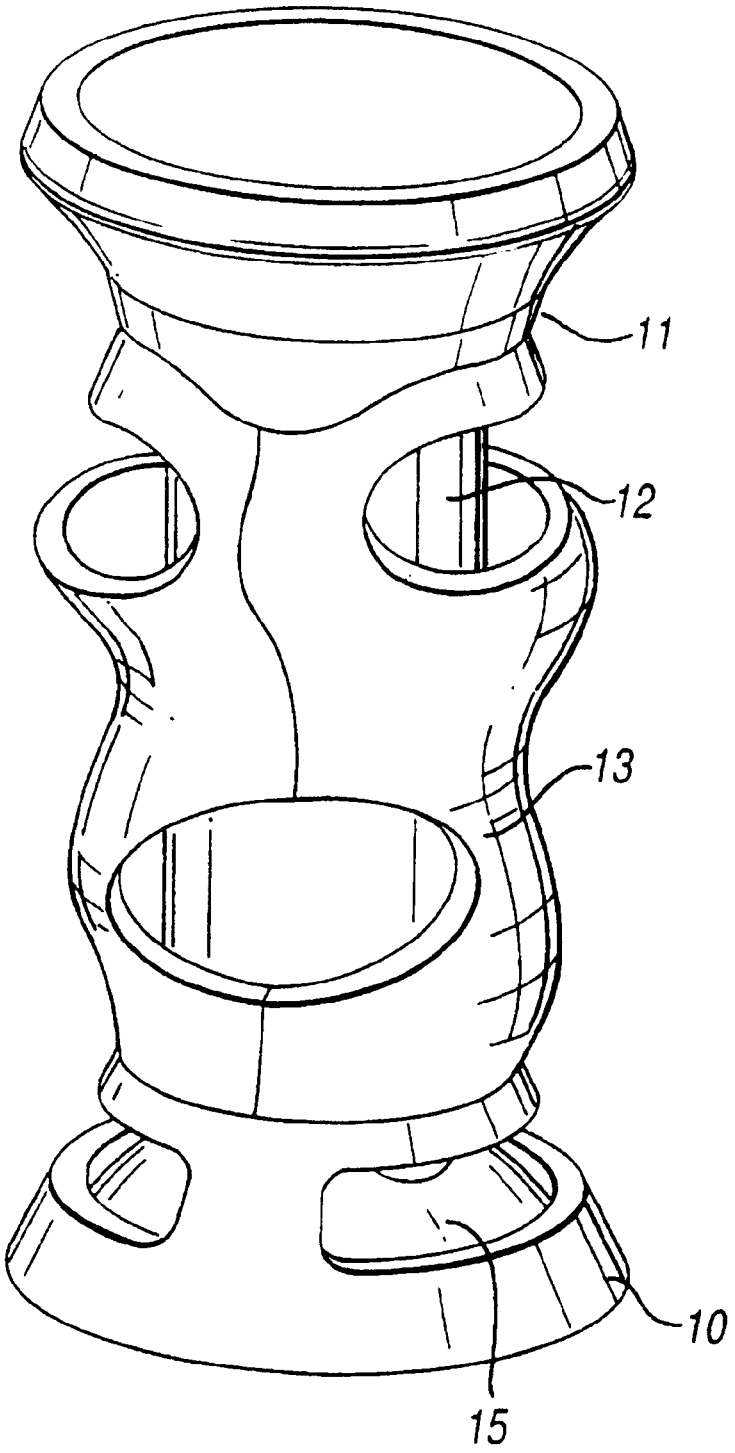

This invention relates to devices and a method for use in the treatment of hair and in particular to a device and method for use in the waving of hair.

In previously known methods of waving or imparting a curl to hair, the hair is rolled onto a roller and subjected to heat and/or to a hair treatment chemical which has the effect of retaining the waving or curling in the hair for a period of time. An improved method of imparting a curl or wave to hair is disclosed in WO 95/22920. In this latter disclosed method, a tress of hair is inserted into an elastic tube and one end of the tube is secured to the tress of hair. The elastic tube is then extended lengthwise and the opposite end thereof is secured to the tress of hair. When the elastic tube is released, the tube contracts lengthwise and the tress of hair contained therein is thereby caused to assume a sinuous form. The tress of hair is treated with a chemical substance, either prior to insertion of the tress of hair into the elastic tube or when the tress of hair is contained within the tube, whereby the tress of hair is caused to retain its sinuous form and is of waved form.

According to one aspect of the invention a device for use in imparting a wave to a tress of hair comprises a body having a hollow interior and first and second apertures communicating with said hollow interior; said first and second apertures providing means whereby the tress of hair can be drawn to extend through the hollow interior with the first aperture located adjacent a root end of the tress of hair and said second aperture providing means whereby a free end of the tress of hair extending from the hollow interior through the second aperture can be inserted into the hollow interior.

According to a second aspect of the invention a device for use in imparting a wave to a length of a tress of hair comprises a tube open at, at least, one end to receive the length of a tress of hair extending lengthwise of the tube; said tube being extendible lengthwise by manually applied force and contractible to return to an unextended state when the manual force is removed; and first and second means located respectively at first and second positions spaced lengthwise of the tube effective to locate said first and second positions of said tube respectively relative to the length of the tress of hair.

According to a third aspect of the invention a device for use in imparting a wave to a tress of hair comprises a tubular element extendible lengthwise; a first structure secured to a first end of said tube; a second structure secured to a second end of said tube, said second end being opposite to and spaced from said first end; said first and second structures having apertures extending therethrough in communication with the interior of the tube; and a body member located between said first and second structures; said body member being of generally tubular form surrounding said tubular element and being effective to locate one of said structures relative to the other of said structures and permitting manual displacement of one structure away from the other structure to allow lengthwise extension of the tubular element.

According to a fourth aspect of the invention a method of treating hair includes the steps of passing a length of a tress of hair through a hollow member so that the tress of hair extends through said hollow member and a part of said length of the tress of hair extends beyond the hollow member; locating the hollow member relative to the tress of hair at a first location along the length of the tress of hair; returning said part of said length of the tress of hair into the hollow member to cause said part to assume a waved condition; and subjecting the hair contained within the tube to a chemical hair treatment substance effective to retain the hair substantially in said waved condition.

According to a fifth aspect of the invention a method of treating hair includes the steps of inserting a tress of hair into a tube of extendible material; locating a first part of the tube relative to the tress of hair at a first location along the length of the tress of hair; extending said tube lengthwise whereby a second part of said tube spaced from said first part is moved lengthwise relative to the tress of hair to a second location along the length of the tress of hair; causing the tube to return to an unextended state while maintaining the second location of the tress of hair adjacent the second part of the tube to thereby cause the hair contained in the tube to assume a waved form; and subjecting the hair contained within the tube to a chemical hair treatment substance effective to retain the hair substantially in said waved form.

The invention also encompasses a comb suitable for use with the device hereinbefore defined and suitable for use in the method hereinbefore defined, said comb including a comb element having a plurality of teeth extending from a spine element in a direction substantially perpendicular to said spine element; a first element having a tapered end and extending from a first end of said spine element and a second element extending from a second end, opposite to said first end, of the spine element; said second element including a hook member at a free end of the second element remote from the spine element.

Figure 2:
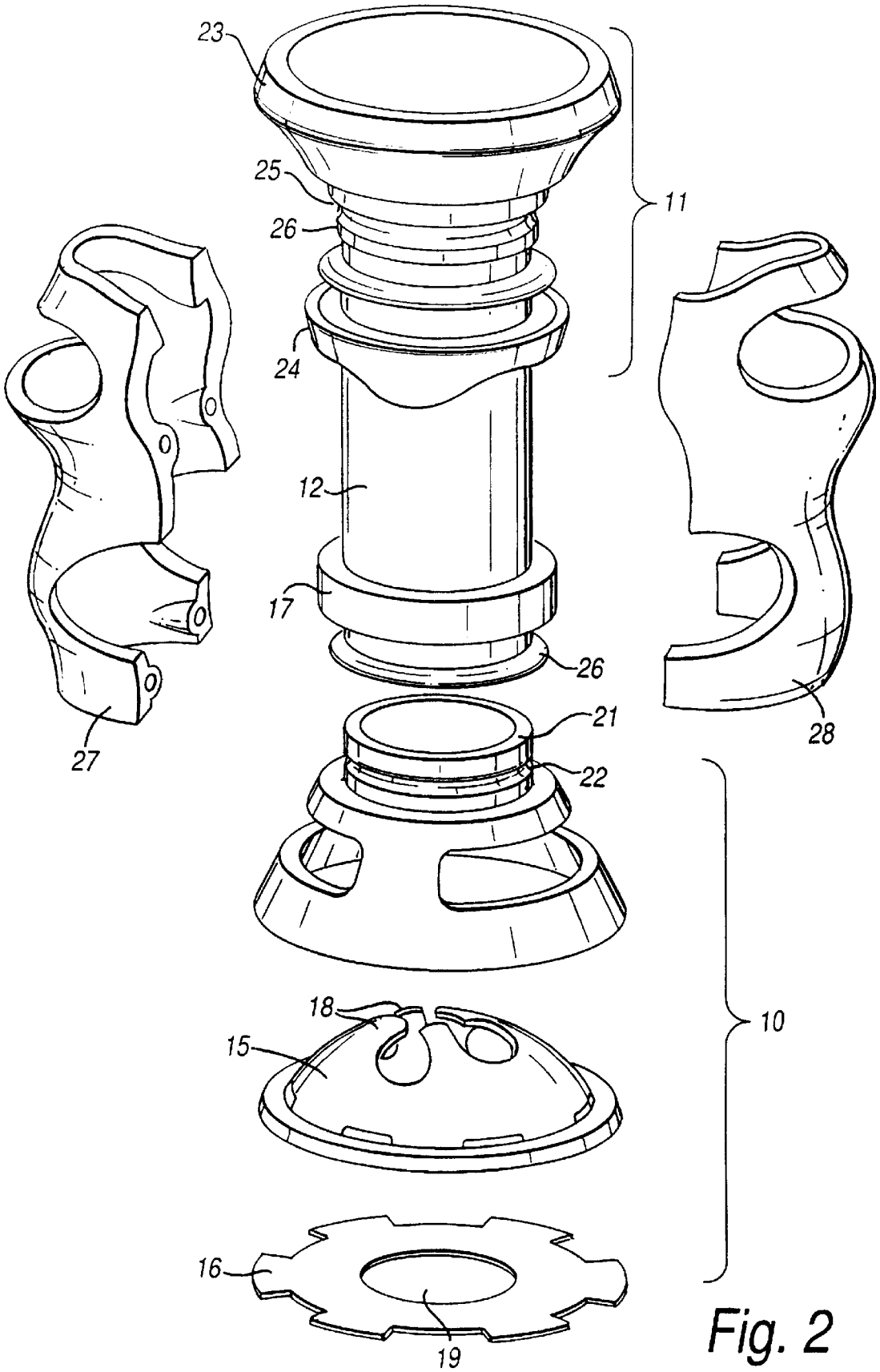
Figure 3:
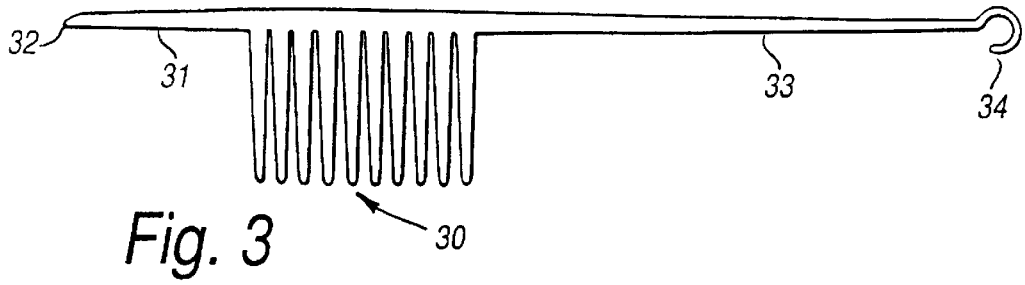
Figure 4:
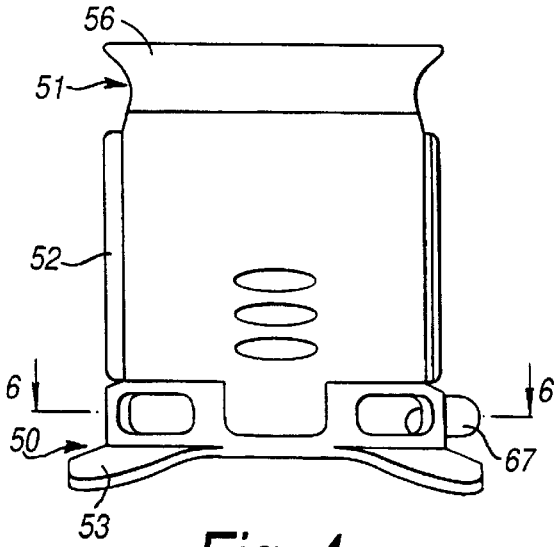
Figure 5:
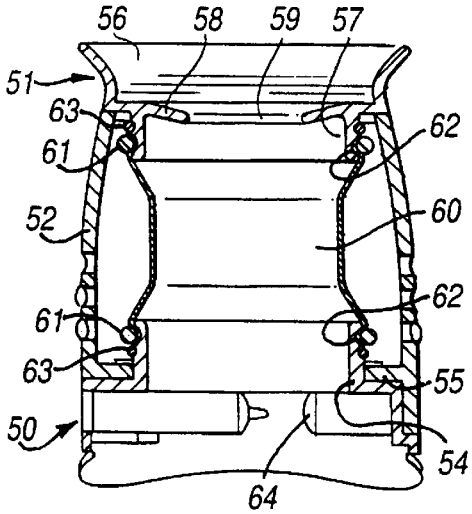
Figure 6:
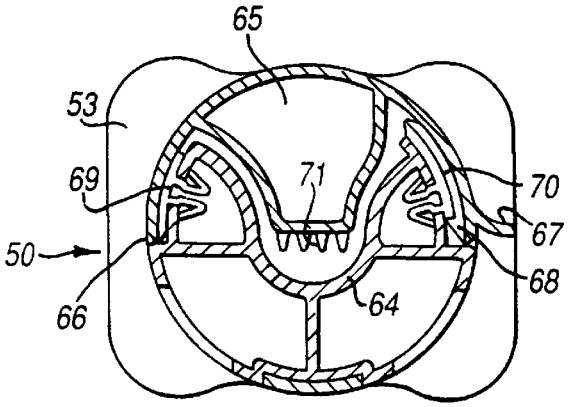

Embodiments of the invention will now be described by way of example with reference to the drawings in which:

FIG. 1 is a perspective view of a device in accordance with the invention for treating hair, FIG. 2 is an exploded view showing the components of the device of FIG. 1, FIG. 3 shows a modified comb for use with the device, FIG. 4 is a side elevation of an alternative construction of device in accordance with the invention, FIG. 5 is an axial section of the device of FIG. 4, and FIG. 6 is a transverse section of the device on the line 6—6 of FIG. 4.

Referring first to FIG. 1 of the drawings, a device for use in treatment of a tress of hair comprises a base structure 10, an upper structure 11, an elastic tube 12 and a body structure 13. The elastic tube 12 has opposite ends thereof secured to the base structure 10 and the upper structure 11 respectively and the body structure extends between the base structure 10 and the upper structure 11 and serves to maintain the upper structure 11 located relative to the base structure 10.

Referring now to FIGS. 1 and 2, the components constituting the base structure 10, the upper structure 11 and the body structure 13 respectively are shown in FIG. 2. The base structure 10 comprises a base member 14, a hair gripping member 15 of generally hemispherical shape, a base plate 16 and a ring 17. The hair gripping member 15 is formed with a plurality of resilient fingers 18 for gripping a tress of hair when inserted in the device. The base plate 16 has an aperture 19 for passage of a tress of hair into the device. When the base structure is assembled, the hair gripping member 15 is located within the base member 14 and is retained therein by means of the base plate being located below the hair gripping member and by the base plate engaging with the base member. An upper part 20 of the base member is formed to receive the ring 17, the upper part 20 being formed with a flange 21 and groove 22 which co-operate with corresponding formations on an inner face of the ring to retain the ring located on the base member.

The upper structure 11 comprises a funnel member 23 and a ring member 24. The lower part of the funnel member is formed to receive the ring member 24, the lower part of the funnel member being formed with a groove 25 and flange 26 which co-operate with corresponding formations on an inner face of the ring member 24 to retain the ring member located on the funnel member 23.

The elastic tube extends between the base structure and the upper structure. One end 26 of the elastic tube is secured to the base member by the wall of the tube being interposed between the ring 17 and the base member 14.

The opposite end of the elastic tube is secured to the upper structure in a similar manner by the wall of the tube being gripped between the ring member 24 and the funnel member.

If desired the one end of the elastic tube may be retained secured to the base structure merely due to an interference fit between the ring 17, the wall of the tube and the base member. Similarly the opposite end of the elastic tube may be retained secured to the upper structure merely due to an interference fit between the ring member 24, the wall of the tube and the funnel member 23. Alternatively the tube may be formed at one or both ends thereof with a flange or a ring-like rib of greater thickness than the wall of the tube so that one or both ends of the tube are secured respectively by location of the flange or rib between the ring and the base member and or between the ring member and the funnel member.

The body structure comprises two body halves 27, 28. The body halves are formed with inter-engaging parts to retain the body halves assembled to one another. The inter-engaging parts may comprise projections and bores to receive the projections. Lower parts 29, 30 of the body halves 27, 28 extend around the base structure so as to locate the body structure relative to the base structure. The ring member 24 of the upper structure rests in engagement with an upper end 31 of the body structure. The length of the body structure is such that, with the body structure assembled and located between the base structure and the upper structure, the elastic tube is very slightly stretched from its unextended state whereby the resilience of the elastic tube retains the upper structure in engagement with the body structure. The body structure may if desired be a tight fit on the base structure to retain the body structure located relative to the base structure or the body structure may be loosely located relative to the base structure and the body member be located relative to the base structure by the resilience of the slightly extended elastic tube.

The modified comb, shown in FIG. 3, for use with the device shown in FIGS. 1 and 2 comprises a comb section 30, first element 31 extending from one end of the comb section and having a tapering end 32 and a second element 33 extending from an opposite end of the comb section and having a hook 34 at the extremity of the element 33. The length of the element 33 is sufficient that, when the element is entered into the funnel of the upper structure 11 of the device of FIG. 1, the element 33 can extend through the device with the hook 34 projecting from the base structure 10.

When a hair dresser is to treat a person's hair, the hair dresser first separates a tress of hair from the remainder of the hair by using the tapering end of the first element of the comb. The hair dresser inserts the second element 33 into the funnel of the upper structure and through the device of FIG. 1 so that the hook projects from the base structure 10 of the device. Having separated the tress of hair, the hook is engaged around the tress of hair and the comb is withdrawn from the device thereby drawing the tress of hair through the device. The device then is seated with the base structure adjacent the scalp of the person. The fingers 18 of the base structure grip the tress of hair adjacent the scalp and serve to retain the device located against the scalp. The tress of hair will be of such length as to extend through and beyond the upper structure. The upper structure is then lifted away from the body member 13 thereby stretching the elastic tube 12 lengthwise. The stretching of the elastic tube may be of such an extent that the stretched elastic tube encloses the entire length of the tress of hair or the stretching may be of lesser extent such that only a part of the length of the tress of hair is enclosed within the stretched elastic tube. Upon release of the upper structure, the elastic tube 12 contracts and draws the upper structure back into engagement with the body member. The funnel 23 tends to restrain the tress of hair from passing outwards from within the elastic tube whereby the length of the tress of hair enclosed by the stretched elastic tube remains enclosed by the elastic tube when the tube returns to its contracted state with the upper structure located on the body member. The contraction of the elastic tube, and hence of the tress of hair enclosed therein causes the tress of hair to assume a sinuous waved form. This waved form may be set into the tress of hair by the application of a chemical hair treatment substance to the hair. This substance may be applied to the hair of the person prior to separation into tresses and waving of the tresses by the use of the stretchable elastic tube device or may be applied after the tresses of hair have been enclosed in elastic tube devices, one for each tress respectively, and resultant waving of the hair. In the latter method of applying the hair treatment substance, the substance in liquid, fluid or gaseous state is entered via the funnel of the upper structure into the interior of the elastic tube whereby the substance is brought into treatment contact with the hair. The treatment substance applied may be at ambient temperature or may be heated prior to or during application thereof to the tress of hair. If desired the base structure may include means to seal against the root end of the tress of hair to prevent egress of the hair treatment substance. Also if desired the lower surface of the base structure, which surface lies adjacent the scalp of the person having the hair treatment, may be provided with a plurality of hook-like elements, known as Velcro, to cause the base structure to cling to the hair adjacent the scalp and assist in retaining the device located relative to the scalp.

An alternative construction of hair treatment device illustrated in FIGS. 4, 5 and 6 is utilised in a similar manner to that of the device described hereinbefore with reference to FIGS. 1, 2 and 3.

The hair treatment device comprises a base element 50, an upper element 51 and a body element 52 of generally cylindrical form interposed between the base element and upper element. The base element has a lower flange portion 53 extending downwardly and outwardly for seating on the scalp of a person whose hair is to be treated. The base element has a cylindrical portion 54 extending into a lower end of the body element and an inwardly extending flange 55 at the lower end of the body element makes an interference engagement with the cylindrical portion 54 of the base element effective to retain the body element on the base element. The upper element 51 has an upwardly and outwardly extending flange 56 to provide a funnel like structure and a cylindrical portion 57 extending into the upper end of the body element. The cylindrical portion 57 of the upper element is a fit in the upper end of the body element such that the upper element is retained on the body member but may be easily removed therefrom. The upper element has a wall 58 extending transversely of the upper element and a central aperture 59 in the wall 58 provides restricted communication with the interior of the body element. A tube 60 of elastic material is secured at its respective ends to the cylindrical portions 54, 57. As shown in the drawings, the ends of the tube 60 are secured to the cylindrical portions by means of resilient 'O' rings 61 pressing the wall of the tube 60 into annular grooves 62 in the cylindrical portions. If desired the ends of the tube 60 may be formed with beads 63 to enhance and facilitate the securing of the tube to the cylindrical portions of the base and upper elements respectively. As shown in FIG. 5, the natural unextended diameter of the tube is slightly smaller than the diameter of the cylindrical portions to which the tube is secured and hence the ends of the tube are stretched to extend onto the cylindrical portions. Also when secured to the cylindrical portions and the upper element is seated in engagement with the body element the tube is subjected to a small extension and is taut. However if desired the length of the tube in relation to the spacing of the cylindrical portions may be greater so that when the upper element is seated in engagement with the body element the tube is slack and not extended. Also the tube may be of increased diameter as compared with that shown in FIG. 5. The base member 50 includes a generally 'U' shaped wall 64 extending upwardly away from the flange 53. A hair securing member 65 is hinged at 66 to permit the hair securing member to be moved away from the wall 64 to an open position to permit a tress of hair to be passed through the base element and to be moved to a closed hair securing position, as shown in FIG. 6, in which the hair securing member 65 is located adjacent the wall 64 to secure the base element to the tress of hair adjacent the root of the tress of hair. The hair securing member is provided with a handle 67 to facilitate moving the member from and to the closed position. The hair securing member is provided with locking means 68 to secure the member in the closed position. Conveniently, as shown in FIG. 6, the hair securing member is formed integrally with a hinge member 69 secured to the base element and with hinged toggle snap lock means 70 also secured to the base element. The hair securing member 65 may be provided with teeth 71 to engage the tress of hair. The body element 52 may be formed of two half elements with integral clip means to secure the half elements to one another or the body element may be two half elements formed integrally with a hinge inter-connecting the half elements and clip means integral with the half elements to secure free edges of the half elements to one another.

When a hair dresser is to treat a person's hair utilising the device illustrated in FIGS. 4, 5 and 6, the hair dresser first separates a tress of hair from the remainder of the hair by using the tapering end of the first element of the comb. The hair dresser then inserts the second element 33 of the comb through the aperture of the upper element and through the base element 50 so that the hook projects from the base element 50 of the device, the hair securing member 65 being in the open position. The hook is engaged around the separated tress of hair and the comb is withdrawn from the device thereby drawing the tress of hair through the device and out through the aperture in the upper element. The device then is seated with the flange 53 of the base element adjacent the scalp of the person. The hair securing member is then moved into the closed position to grip the root of the tress of hair adjacent the scalp and this serves to retain the device located against the scalp. The upper element 51 is then lifted away from the body element 52 thereby stretching and extending the elastic tube lengthwise. The extension of the elastic tube may be of such an extent that the extended elastic tube encloses the entire length of the tress of hair or the extension may be of lesser extent such that only a part of the length of the tress of hair is enclosed within the extended elastic tube. Upon release of the upper structure, the elastic tube contracts and draws the tress of hair into the device, the upper element being drawn back into engagement with the body element. The wall 58 of the upper member tends to retain the tress of hair within the tube and restrain the hair from moving out of the device whereby the length of the tress of hair enclosed by the stretched elastic tube remains enclosed by the elastic tube when the tube returns to its contracted state with the upper element seated in engagement with the body element. The contraction of the elastic tube, and hence of the tress of hair enclosed therein, causes the tress of hair to assume a sinuous waved form. This waved form may be set into the tress of hair by the application of a chemical hair treatment substance to the hair. This substance may be applied to the hair of the person prior to separation into tresses and insertion of the tresses of hair into devices as hereinbefore described or the substance may be applied after the tresses of hair have been enclosed in the hair treatment devices, one for each tress respectively, and resultant waving of the hair. In the latter method of applying the hair treatment substance, the substance in liquid, fluid or gaseous state is entered via the aperture of the upper element, the upper element being used as funnel, into the interior of the elastic tube whereby the substance is brought into treatment contact with the hair. The treatment substance applied may be at ambient temperature or may be heated prior to or during application thereof to the tress of hair. If desired the base element may include means to seal against the root end of the tress of hair to prevent egress of the hair treatment substance. Also if desired the lower surface of the flange 53 of the base element, which surface lies adjacent the scalp of the person having the hair treatment, may be provided with a plurality of hook-like elements, known as Velcro, to cause the base structure to cling to the hair adjacent the scalp and assist in retaining the device located relative to the scalp.

Hereinbefore the treatment of a tress of hair has been described in relation to use of a hair treatment device in which the tress of hair is enclosed in an extendible tube. The extendible tube may be formed of elastic material such as latex but may be formed of other materials or may have a different form of construction. For example the tube may be of woven construction so formed as to permit the tube to be extended lengthwise and to be contracted again either automatically as a result of its construction or the material of which it is formed or manually. In a further form of the hair treatment device a combination of a cylindrical coil spring and an extendible cylindrical impervious wall or membrane may be used. The coils of the coil spring normally lie closely adjacent one another to form a substantially continuous cylindrical wall and the coil spring may be extended lengthwise manually. One end of the coil spring is secured to a base element and the other end of the coil spring is secured to an upper element, said elements being constructed as described with reference to FIGS. 4, 5 and 6. An extendible cylindrical impervious wall or membrane is secured to the coils of the coil spring to retain the tress of hair within the spring and to prevent egress of the hair from within the coil spring through spaces between adjacent coils of the spring. If the coil spring in its natural unextended state is sufficiently rigid, the body element of the device may be dispensed with.

However if desired the tube may be dispensed with and the tress of hair, after pulling through the device as hereinbefore described, is pushed manually back into the device where the hair is retained within the generally cylindrical body element. While the hair may be treated in this manner, it is more convenient to provide an extendible tube which acts automatically to draw the tress of hair back into the device when, after stretching of the tube, the tube is contracted. It will be appreciated that if the tube is elastic and under slight tension lengthwise when the upper element is engaged with the body element, when the upper element is released, the tube will cause the upper element to engage and seat in the body element. However if the tube is of greater length so that it is slack and is not taut the upper element will not be drawn fully into seating engagement with the body element by contraction of the tube and the upper element will need to be seated manually into the body element.

The terms wave and waving used in the specification and claims are not to be taken as limiting the invention. These terms are to be understood as relating to any form imparted to the hair and include for example forms commonly referred to as waved or curled.

It will be appreciated that the base structure, upper structure and body member of the first embodiment and the base element, body element and upper element of the alternative embodiment described hereinbefore may be constructed in various ways. Conveniently these components may be manufactured of synthetic plastics material by moulding. However these components may be manufactured in any other convenient and suitable manner. The terms "upper" and "lower" used hereinbefore refer to the device as illustrated in the drawings and are not to be taken as indicating a particular orientation of the device or otherwise limiting the invention.

What is claimed is:

1. A device for use in imparting a wave to a tress of hair including a tubular element comprising a tubular wall to receive a tress of hair extending therethrough;

said tubular element having first and second ends;

a first structure secured to said first end of said tubular wall;

said first structure including first hair engaging means operable to locate said first structure relative to a length of a tress of hair extending through the tubular element;

a body member extending from said first structure and extending around said tubular element;

a second structure secured to said second end of said tubular element;

said second structure being removably supported by said body member;

said tubular element being in an initial state in which a spacing of the first and second ends is determined by the second structure being supported by said body member and said tubular element being extendible lengthwise from said initial state to an extended state by displacement of the second structure away from the first structure; and said second structure including second hair engaging means operative to retain hair within the tubular element during retraction of the tubular element from the extended state to the initial state.

2. A device as claimed in claim 1 wherein the body member is secured to the first structure.

3. A device as claimed in claim 1 wherein the tubular wall is taut lengthwise when the tubular element is in the initial state.

4. A device as claimed in claim 1 wherein the tubular wall is slack lengthwise when the tubular element is in the initial state.

5. A device as claimed in claim 1 wherein said first hair engaging means is manually operable between hair engaging and hair releasing states.

6. A device as claimed in claim 5 wherein the first hair engaging means includes a snap lock toggle mechanism operable to retain the first hair engaging means in the hair engaging state.

7. A device as claimed in claim 6 wherein the first structure includes a surface to seat on a scalp of a person receiving hair treatment.

8. A device as claimed in claim 1 wherein the second hair engaging means of the second structure comprises a wall extending transversely across the second end of the tubular element and an aperture in said wall restricting communication with the interior of the tube.

9. A device as claimed in claim 8 wherein the second structure includes a funnel element communicating with the aperture.

10. A device as claimed in claim 1 wherein the first structure includes a first cylindrical wall extending in an interference fit into the first end of the tubular wall and the first end of the tubular wall is secured to the first cylindrical wall.

11. A device as claimed in claim 1 wherein the second structure includes a second cylindrical wall extending in an interference fit into the second end of the tubular wall and the second end of the tubular wall is secured to the second cylindrical wall.

12. A device as claimed in claim 10 wherein the first cylindrical wall includes a first annular groove and a first resilient ring extending around the first end of the tubular wall; said first resilient ring being is operative to urge the tubular wall into said first annular groove.

13. A device as claimed in claim 11 wherein the second cylindrical wall includes a second annular groove and a second resilient ring extending around the first end of the tubular wall; said second resilient ring being operative to urge the tubular wall into said second annular groove.

14. A device as claimed in claim 1 wherein the tubular wall of the tubular element is formed of elastic material.

15. A device as claimed in claim 1 wherein the tubular element is of woven construction.

16. A device for imparting a wave to a tress of hair comprising:

a tubular element comprising a cylindrical wall extendible lengthwise to receive a tress of hair extending internally through an interior of the cylindrical wall;

said cylindrical wall having first and second opposite ends;

a first annular element having a first central aperture extending axially therethrough;

said first annular element secured coaxially to said first end of the cylindrical wall with said first central aperture in communication with the interior of the cylindrical wall;

a second annular element having a second central aperture extending axially therethrough;

said second annular element secured coaxially to said second end of the cylindrical wall with said second central aperture in communication with the interior of the cylindrical wall;

first hair engaging means on said first annular element operable to secure the first annular element to the tress of hair extending through the cylindrical wall;

support means on said first annular element removably supporting said second annular element;

said first and second ends being spaced at a first spacing determined by the second annular element when supported by said support means;

said cylindrical wall of said tubular element being extendible lengthwise from an initial state to an extended state to increase said first spacing to a second spacing by displacement of the second annular element in an axial direction away from the first annular element; and second hair engaging means on said second annular element operative to retain hair of said tress of hair within the cylindrical wall during a retraction of the cylindrical wall from the extended state to the initial state.

17. A device as claimed in claim 16 wherein the second hair engaging means of the second annular element comprises a restriction wall extending transversely across the second end of the tubular element; said wall having an aperture therein of smaller transverse dimension that a transverse dimension of the second end of the tubular element; said wall restricting communication with the interior of the tube.

18. A device as claimed in claim 17 wherein the first annular element includes a first annular wall extending coaxially into the first end of the cylindrical wall of the tubular element and the first end of the cylindrical wall is secured to said first annular wall.

19. A device as claimed in claim 18 wherein the second annular element includes a second annular wall extending coaxially into the second end of the cylindrical wall of the tubular element and the second end of the cylindrical wall is secured to said second annular wall.

* * * * *